US008480071B2

(12) United States Patent
Asada et al.

(10) Patent No.: US 8,480,071 B2
(45) Date of Patent: Jul. 9, 2013

(54) RECORDING DEVICE

(75) Inventors: Tetsuo Asada, Kuwana (JP); Hirotaka Aoki, Nagoya (JP); Yasuhira Ota, Yatomi (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/429,689

(22) Filed: Mar. 26, 2012

(65) Prior Publication Data

US 2012/0319345 A1 Dec. 20, 2012

(30) Foreign Application Priority Data

Jun. 16, 2011 (JP) ..... 2011-133894

(51) Int. Cl.
*B65H 5/22* (2006.01)

(52) U.S. Cl.
USPC ..... 271/3.15; 271/3.17; 271/4.08; 271/4.1; 271/242; 271/258.01

(58) Field of Classification Search
USPC ..... 271/3.15, 3.17, 4.08, 4.1, 242, 233, 271/258.01; 347/104; 399/388, 397
See application file for complete search history.

(56) References Cited

U.S. PATENT DOCUMENTS

| | | | | |
|---|---|---|---|---|
| 5,246,224 | A | 9/1993 | Matsuno et al. | |
| 7,762,549 | B2 * | 7/2010 | Hirai | 271/270 |
| 7,912,384 | B2 * | 3/2011 | Dan | 399/16 |
| 2003/0015833 | A1 * | 1/2003 | Johnson et al. | 271/3.15 |
| 2010/0104338 | A1 * | 4/2010 | Udagawa | 399/388 |
| 2010/0226678 | A1 * | 9/2010 | Sato et al. | 399/81 |
| 2011/0049782 | A1 * | 3/2011 | Sakamoto | 271/3.15 |

FOREIGN PATENT DOCUMENTS

| | | |
|---|---|---|
| JP | H03-177247 A | 8/1991 |
| JP | H10-152249 A | 6/1998 |
| JP | 2005-154100 A | 6/2005 |

* cited by examiner

*Primary Examiner* — David H Bollinger
(74) *Attorney, Agent, or Firm* — Baker Botts L.L.P.

(57) ABSTRACT

A recording device that includes a feed roller for feeding a first and a second sheets sequentially, a first and a second conveying devices that convey the sheets in synchronization, a recording device that records image on the sheets, and a controller, that, after image recording on the first sheet is complete, stops the first and second conveying devices when a trailing end of the first sheet reaches a particular position between the first and the second conveying devices. The controller further controls the feed roller to feed the second sheet, such that a leading end of the second sheet contacts a nip of the first conveying device. After the leading end of the second sheet contacts the nip, the controller rotates the first conveying device in a reverse direction.

9 Claims, 12 Drawing Sheets

RECORDING DEVICE

CROSS-REFERENCE TO RELATED APPLICATION

This application claims priority from Japanese Patent Application No. 2011-133894, filed on Jun. 16, 2011, which is incorporated herein by reference.

BACKGROUND OF THE INVENTION

1. Field of the Invention

The present invention relates generally to recording devices configured to feed a first sheet and a second sheet to a conveying path and to perform image recording on each of the first sheet and the second sheet.

2. Description of Related Art

A known recording device feeds a plurality of sheets sequentially to a conveying path and performs image recording on each of the plurality of sheets. Because a sheet fed to the conveying path may be skewed, a registration process is performed to correct a sheet skew before image recording.

SUMMARY OF THE INVENTION

Examples of registration processing may include reverse registration. In the reverse registration, before the leading end of a sheet fed by a feeding roller reaches a conveying roller, the conveying roller may be reversed to bring the leading end of the sheet into contact with the reversed conveying roller. The position of the leading end of the sheet may be determined, for example, based on an output signal from a sensor disposed along the conveying path and the amount of rotation of the feeding roller. The feeding roller may slip relative to the sheet. For example, if the length of time, which extends from when the feeding roller starts to rotate to feed the sheet until when the sensor detects the sheet, is greater than a predetermined value, or if the amount of rotation of the feeding roller, which occurs to feed the sheet to a position where the sensor detects the sheet, is greater than a predetermined value, it may be determined that the sheet slips relative to the feeding roller. When the sheet slips relative to the feeding roller, the amount of rotation of the feeding roller, which occurs between when the sensor detects the sheet until when the leading end of the sheet reaches the conveying roller, may increase to an amount greater than a predetermined value by an amount corresponding to the slip. If reverse rotation of the conveying roller is configured to start when the sensor detects the sheet, a slip of the sheet relative to the feeding roller may cause an increase in the amount of reverse rotation of the conveying roller by an amount corresponding to the slip.

Recording devices may provide high speed processing. Therefore, before a sheet, which already has been subjected to image recording, e.g., an "image-recorded sheet," is completely discharged, the next sheet to be subjected to image recording, e.g., a "next sheet" may be fed to a conveying path. For example, in an inkjet image recording device, conveying rollers disposed both upstream and downstream of a recording head may be rotated in synchronization with each other. Thus, before an image-recorded sheet completely passes through the conveying roller on the downstream side, the conveying roller on the upstream side may perform reverse registration on the next sheet. Consequently, the image-recorded sheet conveyed backward by the conveying roller on the downstream side may be prevented from reaching the conveying roller on the upstream side.

Nevertheless, if a sheet slips relative to the feeding roller, the amount of reverse rotation of the conveying roller on the upstream side may be increased by an amount corresponding to the slip. Because the amount corresponding to the slip may vary, it may be difficult to precisely control the amount of reverse rotation of the conveying roller on the upstream side. Thus, the image-recorded sheet may be brought back to the conveying roller on the upstream side. Consequently, for reverse registration, the next sheet may be fed after the image-recorded sheet completely passes through the conveying roller on the downstream side.

Alternatively, to feed the next sheet before the image-recorded sheet completely passes through the conveying roller on the downstream side, a stop registration may be performed. In the stop registration, the conveying roller on the upstream side may be stopped, instead of rotating in reverse, and the skew correction may be performed by bringing the leading end of the next sheet into contact with the stopped conveying roller. Nevertheless, the stop registration process may have a reduced skew correction capability than that of the reverse registration process.

A conveying roller is supplied with a driving force transmitted from a driving source, e.g., a motor, through a plurality of gears arranged in a row. Therefore, if the conveying roller is rotated forward to convey a sheet to a predetermined stop position after reverse registration is performed, a driving force transmitted from the driving source may be reduced by the amount of backlash in the engagement of the gears. On the other hand, if the conveying roller is rotated forward to convey the sheet to a predetermined stop position after the conveying roller being rotated forward is stopped and a sheet is registered, a backlash in the engagement of the gears may not affect the transmission of a driving force to the conveying roller. Therefore, if both reverse registration and stop registration are performed on sheets sequentially fed, there may be a variation in stop positions between the sheets. As a result, the position of an image recorded on each of the sheets may vary.

The present invention may solve at least one of the problems described above. The present invention may increase the speed of image recording by feeding the next sheet to a conveying path before an image-recorded sheet is discharged completely. Thus, the registration process may have a greater capability of correcting a skew of the next fed sheet than that of registration processing performed by a conveying roller in a stopped state.

Further, the present invention may reduce or prevent a variation in stop position between sequentially fed sheets even if both reverse registration and stop registration are performed on the sheets.

According to an embodiment of the invention, a recording device comprising: a feed roller configured to feed a first sheet and a second sheet sequentially; a first conveying device configured to convey the first sheet and the second sheet and disposed downstream from the feed roller in a feeding direction, wherein the first conveying device comprises a first driving roller and a first driven roller facing each other; a recording device configured to perform image recording on the first sheet and the second sheet and disposed downstream from the first conveying device in a conveying direction; a second conveying device configured to convey the first sheet and the second sheet in synchronization with the first conveying device and disposed downstream from the recording unit in the conveying direction, wherein the second conveying device comprises a second driving roller and a second driven roller facing each other; and a controller configured to control operations of the feed roller, the first conveying device, the second conveying device, and the recording device, wherein after image recording on the first sheet by the recording unit is complete, the controller is configured to: stop the first conveying device and the second conveying device when a trailing end of the first sheet reaches a particular position downstream from the first conveying device and upstream from the second conveying device; control the feed roller to feed the second sheet, such that a leading end of the second sheet contacts a nip between the first driving roller and the first driven roller of the first conveying device in a stopped state; stop the feed roller after the leading end of the second sheet contacts the nip between the first driving roller and the first driven roller; rotate the first driving roller, which is in contact with the leading end of the second sheet, in a reverse direction opposite the conveying direction by an amount of rotation, such that the trailing end of the first sheet does not reach the first conveying device; and control the recording device to perform image recording on the second sheet conveyed in the conveying direction by the first conveying unit.

Before the trailing end of the first sheet passes through the second conveying unit, the second sheet may be fed to the conveying path. When the leading end of the second sheet contacts the nip between the first driving roller and the first driven roller, both of which are in a stopped state, the first driving roller may rotate in the reverse direction. Thus, the speed of recording may be increased, and the registration process may have a skew correction capability greater than that of registration processing performed by a conveying roller in a stopped state.

Moreover, even if both reverse registration and stop registration are performed on sheets sequentially fed, a variation in stop positions between the sheets may be prevented.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
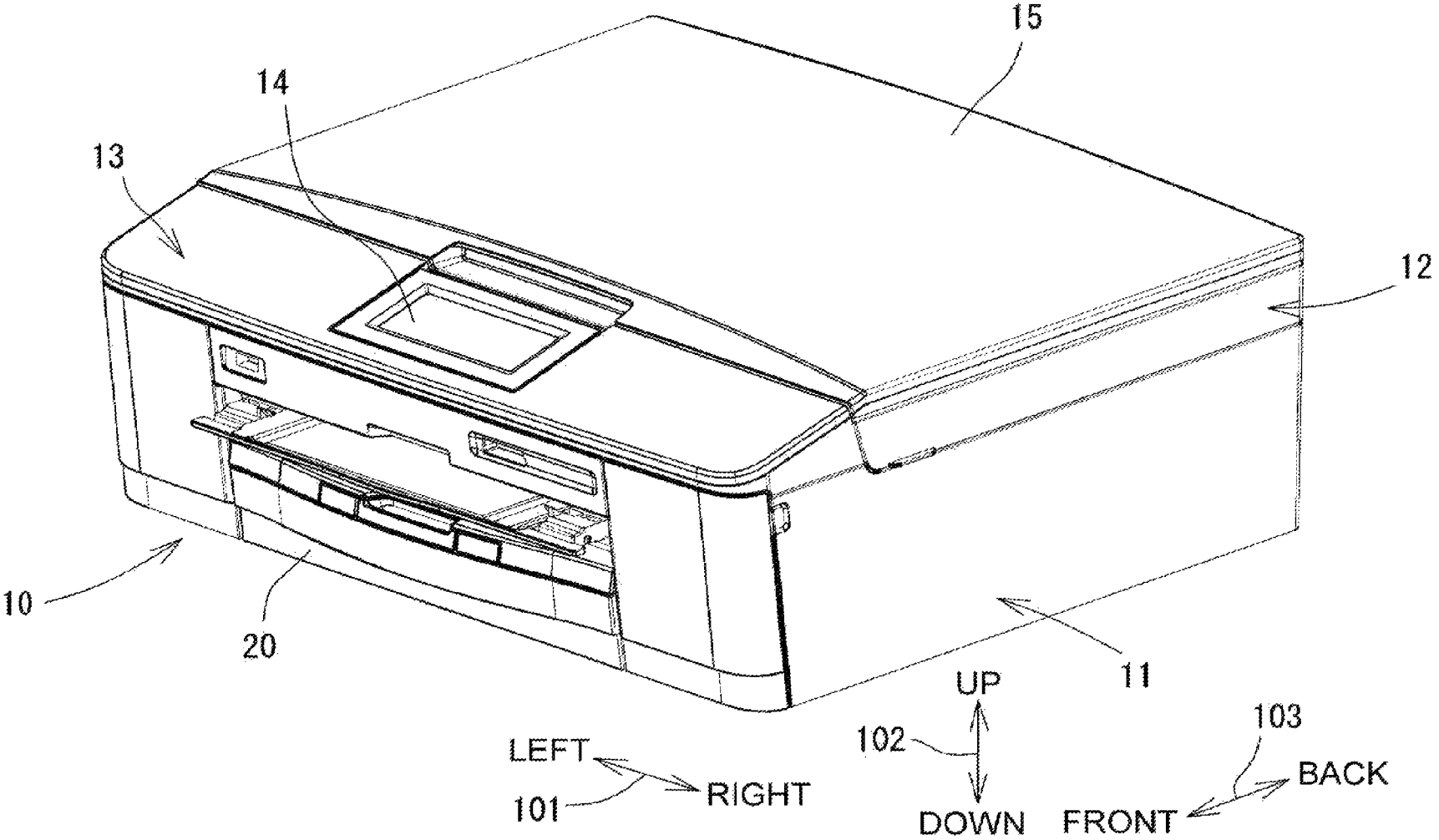
FIG. 1 is a perspective view of a multifunction peripheral according to an embodiment of the present invention.

Embodiments of the invention now are described in detail with reference to the accompanying drawings; like reference numerals are used for like corresponding parts in the various drawings.

Multifunction Peripheral

As depicted in FIG. 1, a multifunction peripheral 10 may be a multifunction device (MFD) which may comprise a printer section 11 disposed in the lower part and a scanner section 12 disposed above the printer section 11. The multifunction peripheral 10 may comprise one or more of a printing function, a scanning function, a copying function, and a facsimile function. Reference numeral 101 may denote a width direction, e.g., a right-left direction, of the multifunction peripheral 10, reference numeral 102 may denote a height direction, e.g., an up-down direction, of the multifunction peripheral 10, and reference numeral 103 may denote a depth direction, e.g., a front-back direction, of the multifunction peripheral 10.

An operation panel 13 for operating the printer section 11 and the scanner section 12 may be disposed on the front side of the upper surface of the multifunction peripheral 10 and on the upper surface of the front side of the scanner section 12. The operation panel 13 may comprise various operation buttons and a liquid crystal display 14. A control unit 70 may control the multifunction peripheral 10 to operate based on an input from the operation panel 13. If the multifunction peripheral 10 is connected to a computer, the multifunction peripheral 10 may operate based on an instruction transmitted from the computer through a printer driver or scanner driver.

The scanner section 12 may be a flatbed scanner. A document cover 15 serving as a top panel of the multifunction peripheral 10 may be disposed over the scanner section 12, such that document cover 15 may be opened and closed freely. A platen glass and an image sensor may be disposed under the document cover 15. An image of a document placed on the platen glass may be read by the image sensor.

Printer Section

Figure 2:
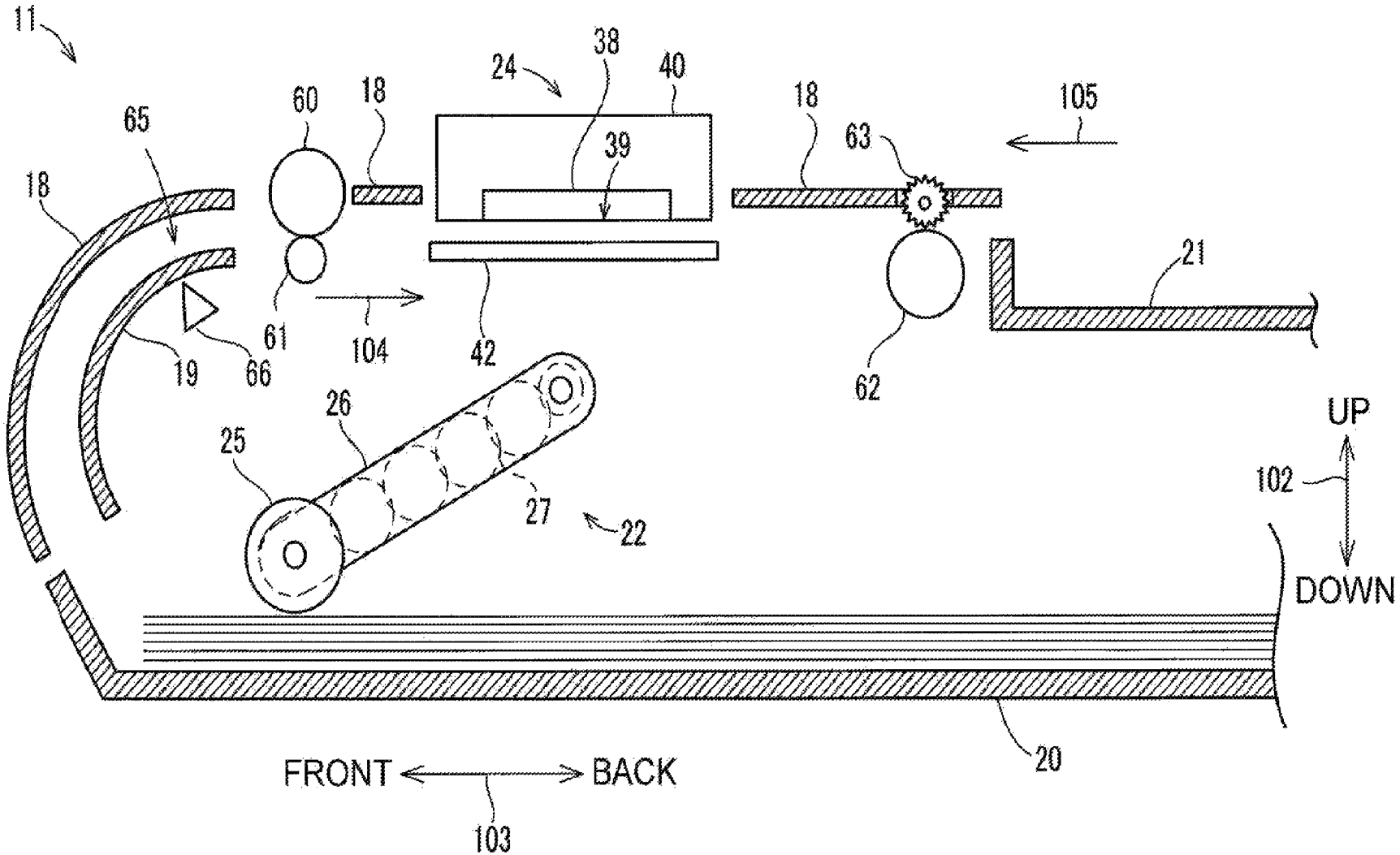
FIG. 2 is a vertical, cross-sectional view depicting an internal structure of a printer section according to an embodiment of the present invention.

As depicted in FIG. 2, the printer section 11 may comprise a feeding unit 22 and a recording unit 24. The feeding unit 22 may feed a recording sheet, e.g., a sheet. The recording unit 24 may be an inkjet recording unit that records an image on a recording sheet. The printer section 11 may record an image on a recording sheet based on print data received from an external device.

The multifunction peripheral 10 may comprise a conveying path 65. The conveying path 65 may extend from the back side of a feed tray 20 and may curve upward and toward the front side of the multifunction peripheral 10. The conveying path 65 further may extend toward the front side of the multifunction peripheral 10, pass under the recording unit 24, and lead to an output tray 21. A recording sheet may be conveyed along the conveying path 65 in a conveying direction 104. The conveying path 65 may be defined by an outer guide member 18 and an inner guide member 19 facing each other with a predetermined distance therebetween.

Figure 3:
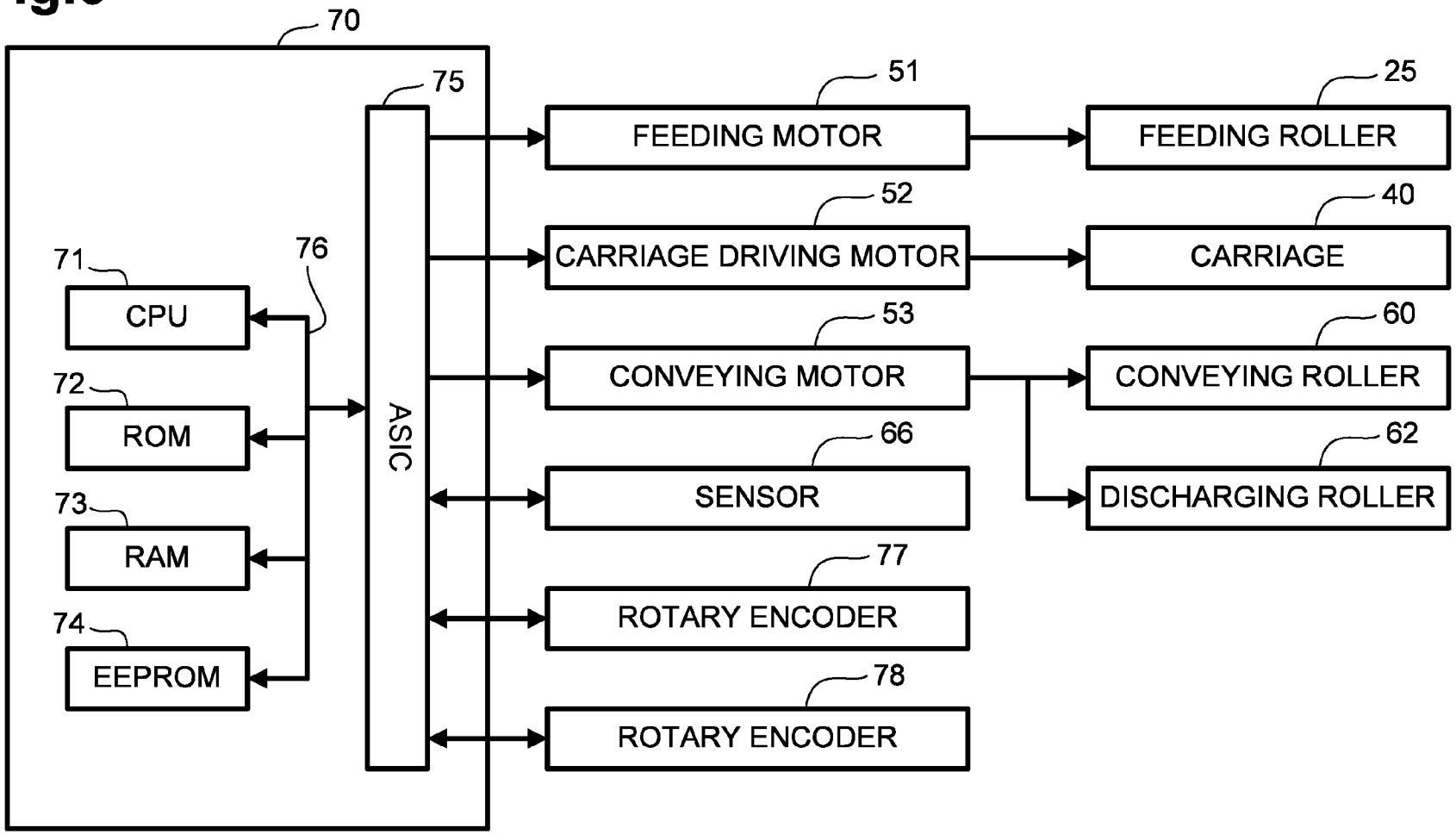
FIG. 3 is a diagram depicting a configuration of a control unit according to an embodiment of the present invention.

The feeding unit 22 may be disposed above the feed tray 20. The feeding unit 22 may comprise a feeding roller 25, a feeding arm 26, and a driving-force transmitting mechanism 27. The feeding roller 25 may be rotatably supported at an end of the feeding arm 26 that may pivot to selectively contact and separate from the feed tray 20. The feeding roller 25 may be rotated by a driving force of a feeding motor 51, as depicted in FIG. 3. The driving force may be transmitted to the feeding roller 25 by the driving-force transmitting mechanism 27, which comprises a plurality of gears engaging with one another. An uppermost recording sheet of a plurality of recording sheets loaded on the feed tray 20 may be fed by the feeding roller 25 to the conveying path 65.

The recording unit 24 may be disposed on the upper side of the conveying path 65, which may extend from the back side to the front side of the multifunction peripheral 10. The recording unit 24 may comprise a carriage 40 equipped with a recording head 38. The carriage 40 may reciprocate in a main scanning direction, e.g., the width direction 101 perpendicular to the plane of FIG. 2. The recording head 38 may be supplied with ink from an ink cartridge. The recording head 38 may eject minute ink droplets from nozzles 39. A platen 42 may support a recording sheet. By reciprocation of the carriage 40 in the main scanning direction, the recording head 38 may move relative to the recording sheet supported by the platen 42. While the recording head 38 moves relative to the recording sheet, ink droplets may be selectively ejected from the nozzles 39 and may land on the recording sheet to form a desired image thereon.

As depicted in FIG. 2, a conveying roller 60, e.g., a first driving roller, and pinch rollers 61, e.g., a first driven roller, may be disposed upstream of the recording unit 24 in the conveying direction 104. The conveying roller 60 may be disposed on the upper side of the conveying path 65. The pinch rollers 61 may be disposed on the lower side of the conveying path 65. The conveying roller 60 and the pinch rollers 61 may face each other substantially in the height direction 102.

Figure 11:
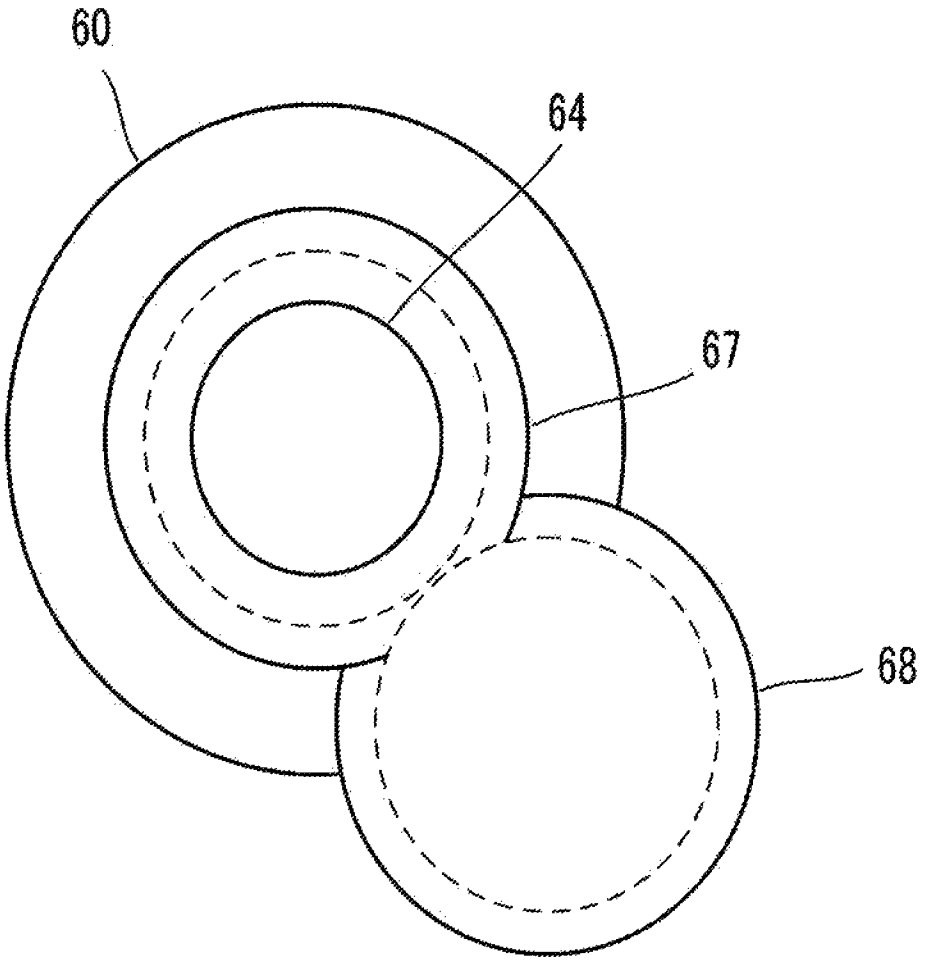
FIG. 11 depicts a shaft and gears according to another embodiment of the present invention.

The conveying roller 60 may be rotatably supported by frames of the printer section 11. The frames may be disposed on each of right and left sides of the conveying path 65. The conveying roller 60 may comprise a narrow cylindrical roller having an axis in the width direction 101. A gear 67, as depicted in FIG. 11, may be disposed at one end of the conveying roller 60. A driving force transmitted from a conveying motor 53, as depicted in FIG. 3, may cause the gear 67 to rotate, which may cause the conveying roller 60 to rotate. The conveying roller 60 may rotate either in a forward or reverse direction depending on the direction of rotation of the conveying motor 53.

The conveying roller 60 may be provided with a rotary encoder 77, as depicted in FIG. 3. The rotary encoder 77 may be disposed coaxially with the conveying roller 60. The amount of rotation of the conveying roller 60 may be detected by the rotary encoder 77, in which an optical sensor may detect a change in transmittance using an encoder disk on which regions of different transmittances may be alternately arranged in the circumferential direction. The feeding roller 25 may be provided with a rotary encoder 78 as depicted in FIG. 3.

The pinch rollers 61 may be separated from each other along the axis of the conveying roller 60. Each of the pinch rollers 61 may have an axis in the width direction 101. The pinch rollers 61 may be separated from each other in the width direction 101. Each of the pinch rollers 61 may be rotatably supported at both right and left ends thereof in the axial direction, such that each pinch rollers 61 may move in the height direction 102. Thus, each of the pinch rollers 61 may move to selectively contact and to separate from the conveying roller 60. Each of the pinch rollers 61 may be biased by a coil spring toward the conveying roller 60.

Discharging rollers 62, e.g., a second driving roller, and spur rollers 63, e.g., a second driven roller, may be disposed downstream of the recording unit 24 in the conveying direction 104. The discharging rollers 62 may be disposed on the lower side of the conveying path 65. The spur rollers 63 may be disposed on the upper side of the conveying path 65. The discharging rollers 62 and the spur rollers 63 may face each other substantially in the height direction 102. The discharging rollers 62 and the spur rollers 63 may be separated from each other along the axis of the conveying roller 60. Each of the spur rollers 63 may be supported to selectively contact and to separate from the corresponding discharging roller 62. Each of the spur rollers 63 may be biased by a coil spring toward the corresponding discharging roller 62.

The discharging rollers 62 may be mounted on a shaft, which may be provided with a pulley at one end thereof. The conveying roller 60 may also be provided with a pulley at one end thereof. A belt may wrap around the two pulleys. When a driving force transmitted from the conveying motor 53, as depicted in FIG. 3, rotates the conveying roller 60, the rotation of the conveying roller 60 may be transmitted through the belt to the shaft of the discharging rollers 62. This may cause the discharging rollers 62 to rotate in synchronization with the rotation of the conveying roller 60. The amount and direction of rotation of the discharging rollers 62 may be the same as that of the conveying roller 60. Therefore, the amount of rotation of the discharging rollers 62 may be detected by the rotary encoder 77 of the conveying roller 60.

In the conveying path 65, a sensor 66 may be disposed upstream of the conveying roller 60 in the conveying direction 104. The sensor 66 may comprise a detector and an optical sensor. The detector may turn retractably relative to the conveying path 65. When a recording sheet passing along the conveying path 65 contacts the detector, the detector, which may protrude into the conveying path 65, may be pushed to retract from the conveying path 65. When detecting the turning of the detector, the optical sensor may output an electric signal that may vary depending on whether there is a recording sheet in the conveying path 65.

Control Unit

As depicted in FIG. 3, the control unit 70 may control the operation of the multifunction peripheral 10. The control unit 70 may comprise a central processing unit (CPU) 71, a read-only memory (ROM) 72, a random-access memory (RAM) 73, an electrically erasable programmable ROM (EEPROM) 74, an application-specific integrated circuit (ASIC) 75, and a bus 76 that connects these components.

The ROM 72 may store programs, for example, with which the CPU 71 may control various operations of the multifunctional peripheral 10, including record control. The RAM 73 may be a volatile memory. The RAM 73 may be used as a storage area which records temporarily data used when the CPU 71 performs the above-described program, signal, and the like. The EEPROM 74 may store settings and flags, for example, which may be maintained after powering-off.

The feeding motor 51, a carriage driving motor 52, the conveying motor 53, and the sensor 66 may be connected to the ASIC 75. The ASIC 75 may comprise driving circuits that control the respective motors. When a driving signal for rotating a predetermined motor is input from the CPU 71 to a driving circuit corresponding to the predetermined motor, a driving current corresponding to the driving signal may be output from the driving circuit to the predetermined motor. This may cause the predetermined motor to rotate forward or backward at a predetermined speed. Thus, the control unit 70 may control the feeding motor 51, the carriage driving motor 52, and the conveying motor 53.

Recording Operation

The printer section 11 may perform an image recording operation in one of a normal mode and a high-speed feeding mode. In the normal mode, a recording sheet may be first fed from the feed tray 20 to the conveying path 65. After image recording for one page is performed on the recording sheet by the recording unit 24, the resulting recording sheet may be discharged from the conveying path 65 to the output tray 21. If there is data for the next page, another recording sheet may then be fed from the feed tray 20 to the conveying path 65. In the high-speed feeding mode, before an image-recorded recording sheet may be completely discharged from the conveying path 65 to the output tray 21, another recording sheet may be fed from the feed tray 20 to the conveying path 65.

Figure 4:
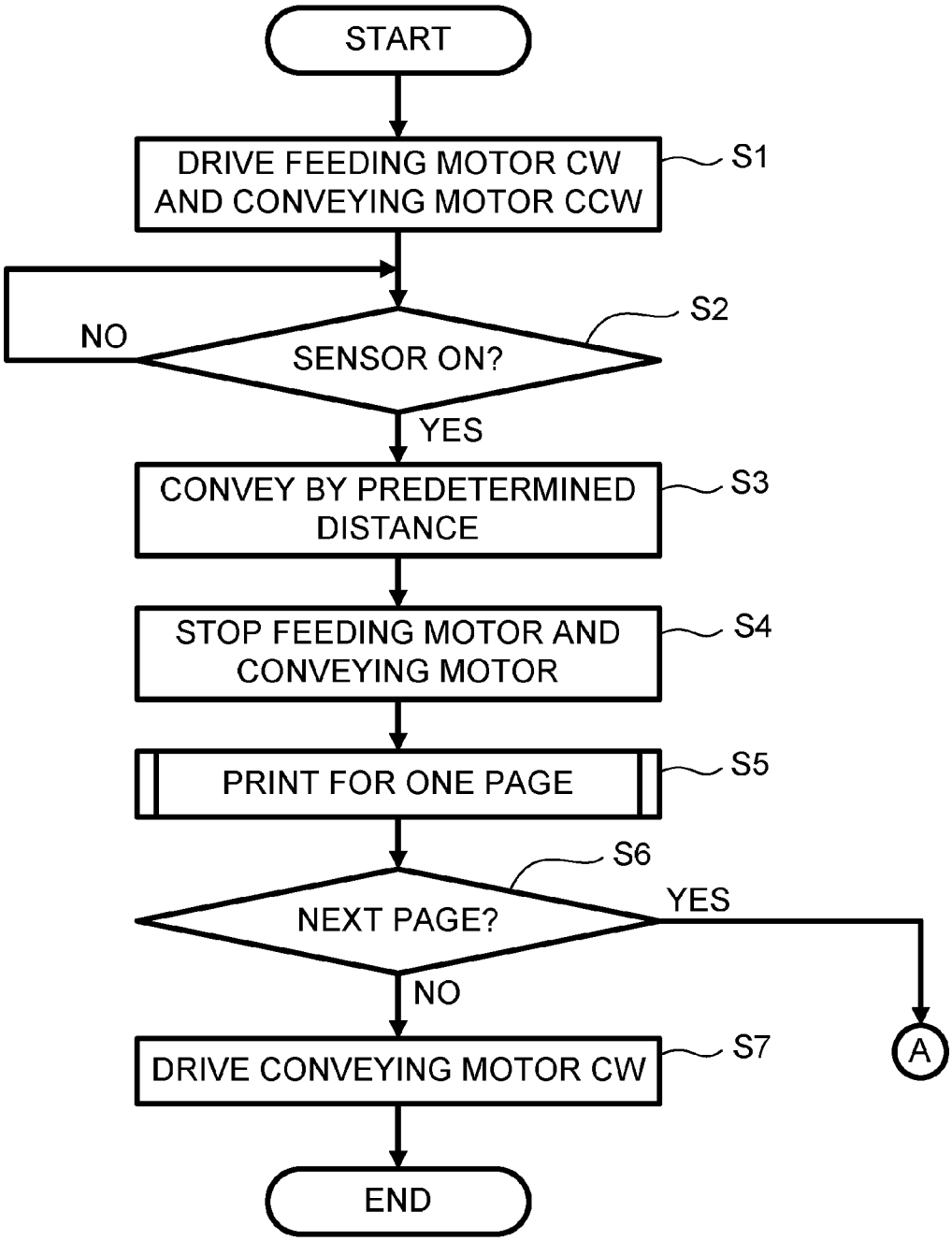
FIG. 4 is a flowchart depicting an image recording operation in high-speed feeding mode according to an embodiment of the present invention.

As depicted in FIG. 4, upon receipt of an instruction to start an image recording operation in high-speed feeding mode, the control unit 70 may drive the feeding motor 51 to rotate clockwise (CW) and may drive the conveying motor 53 to rotate counterclockwise (CCW) in step S1. In another embodiment, the directions of rotations may be reversed, respectively. When the feeding motor 51 rotates CW, the feeding roller 25 may rotate in the direction of feeding a recording sheet from the feed tray 20 to the conveying path 65. When the conveying motor 53 rotates CCW, the conveying roller 60 and the discharging rollers 62 may rotate in a reverse direction 105 opposite the conveying direction 104.

The feeding roller 25 may feed a recording sheet 111 from the feed tray 20 to the conveying path 65. When the leading end of the recording sheet 111 reaches the sensor 66, the sensor 66 may output a detection signal indicating detection of the recording sheet 111 in step S2. When the detection signal is received, the control unit 70 may determine that the leading end of the recording sheet 111 has reached the sensor 66. Until the leading end of the recording sheet 111 reaches a nip between the conveying roller 60 and the pinch rollers 61, the control unit 70 may determines the position of the leading end of the recording sheet 111 based on the amount by which the feeding roller 25 rotates after the receipt of the detection signal from the sensor 66. The amount of rotation of the feeding roller 25 may be determined based on the output of the rotary encoder 78 for the feeding roller 25. After the leading end of the recording sheet 111 reaches the nip between the conveying roller 60 and the pinch rollers 61, the control unit 70 may determine the position of the leading end of the recording sheet 111 based on the amount of rotation of the conveying roller 60. The amount of rotation of the conveying roller 60 may be determined from the output of the rotary encoder 77 for the conveying roller 60.

Figure 6:
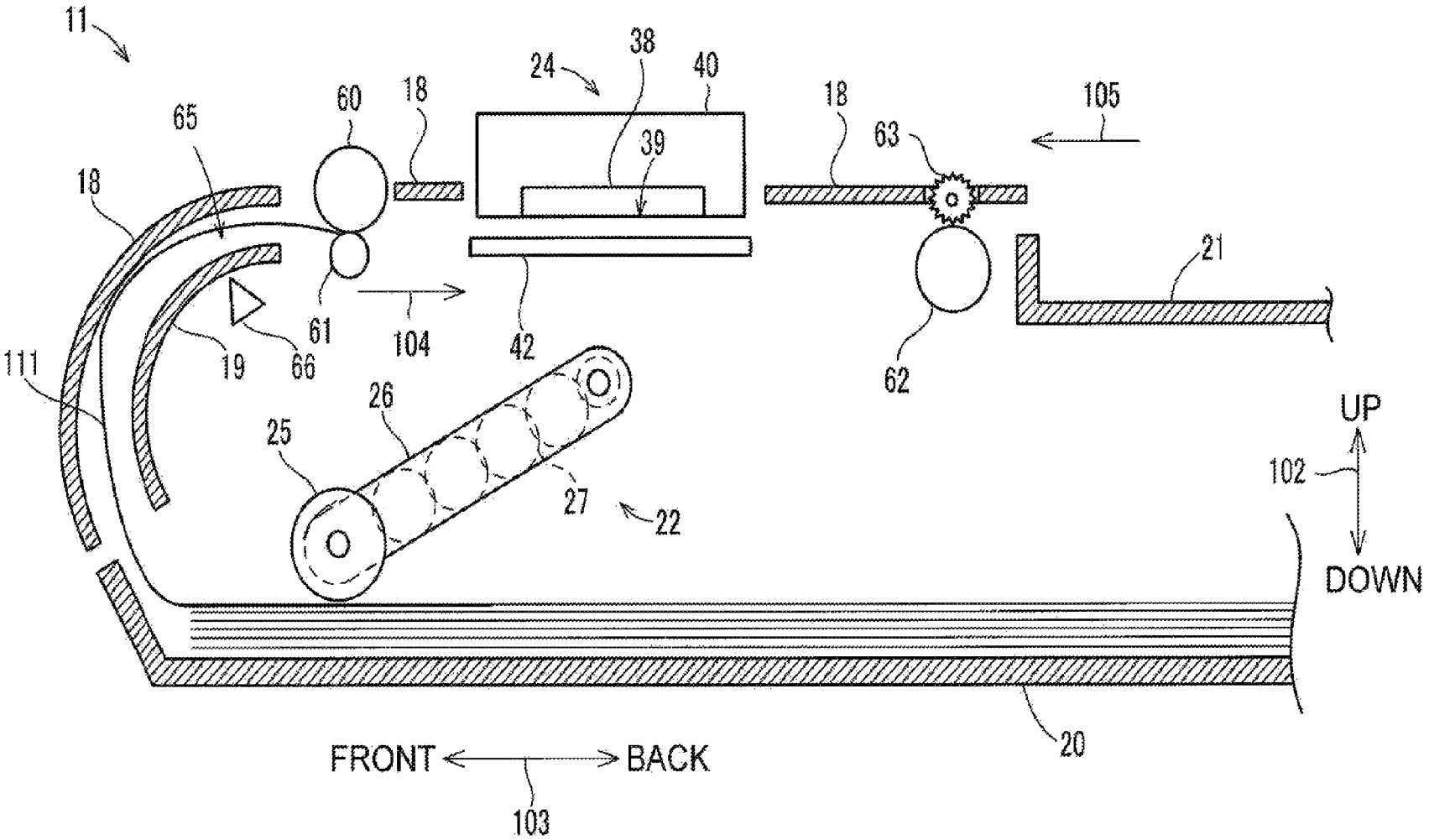
FIG. 6 is a vertical cross-sectional view depicting an image recording operation in high-speed feeding mode according to an embodiment of the present invention.

The control unit 70 may control the feeding motor 51 to further rotate the feeding roller 25 by a predetermined amount after the leading end of the recording sheet 111 reaches the nip between the conveying roller 60 and the pinch rollers 61 in step S3. Thus, as depicted in FIG. 6, the leading end of the recording sheet 111 may contact the conveying roller 60 and the pinch rollers 61 rotating in the reverse direction 105. At the same time, the trailing end of the recording sheet 111 may be conveyed in the conveying direction 104 by the feeding roller 25. Thus, the recording sheet 111 may be warped in the conveying path 65, and the resulting reaction force causes the leading end of the recording sheet 111 to be registered along the nip between the conveying roller 60 and the pinch rollers 61. That is, reverse registration may be performed.

After temporarily stopping the feeding motor 51 and the conveying motor 53 in step S4, the control unit 70 may perform image recording for one page in step S5. The image recording may be performed by driving the conveying motor 53 CW, and the conveying roller 60 and the discharging rollers 62 to rotate in the conveying direction 104. The leading end of the recording sheet 111 may be nipped by the conveying roller 60 and the pinch rollers 61 and conveyed to a stop position on the platen 42. While the conveying motor 53 and the recording sheet 111 are in a temporarily stopped state, the carriage driving motor 52 may be driven to move the carriage 40, relative to the recording sheet 111 on the platen 42, in a horizontal direction orthogonal to the conveying direction 104. During the movement of the carriage 40, minute ink droplets may be selectively ejected from the nozzles 39 of the recording head 38 and may land on the recording sheet 111. After completion of one pass of the carriage 40, the conveying motor 53 may be driven CW again to convey the recording sheet 111 by a predetermined line feed width in the conveying direction 104. Then, the conveying motor 53 may be temporarily stopped, and the carriage driving motor 52 may be driven to move the carriage 40 in the horizontal direction. During the movement of the carriage 40, ink droplets may be selectively ejected from the nozzles 39 of the recording head 38. By repeating such intermittent conveyance of the recording sheet 111 and ejection of ink droplets from the recording head 38, a desired image may be formed on the recording sheet 111.

Figure 5:
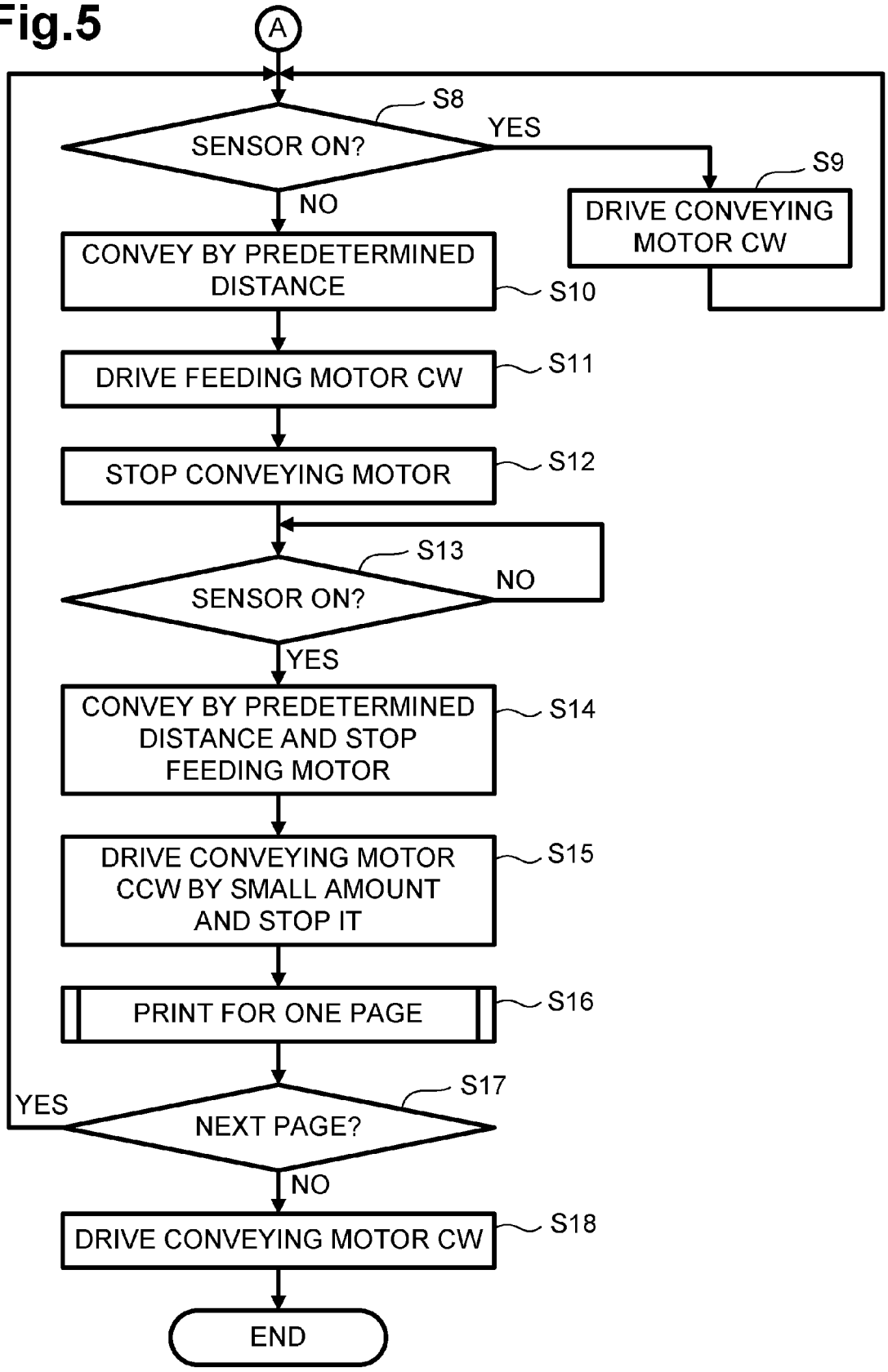
FIG. 5 is another flowchart depicting the image recording operation of FIG. 4.

After completion of the image recording for one page, if there is no print data for the next page, e.g., NO in step S6, the control unit 70 may drive the conveying motor 53 CW to discharge the image-recorded recording sheet 111 to the output tray 21 in step S7. After completion of the image recording for one page, if there is print data for the next page, e.g., YES in step S6, the control unit 70 may stop the conveying motor 53 after completion of the image recording for one page. Then, as depicted in FIG. 5, after completion of image recording for one page, the control unit 70 may determine whether the sensor 66 outputs a detection signal indicating detection of the recording sheet 111 in step S8. If the determination is made immediately after completion of image recording, the control unit 70 may not stop the conveying motor 53 after completion of image recording for one page.

Figure 7:
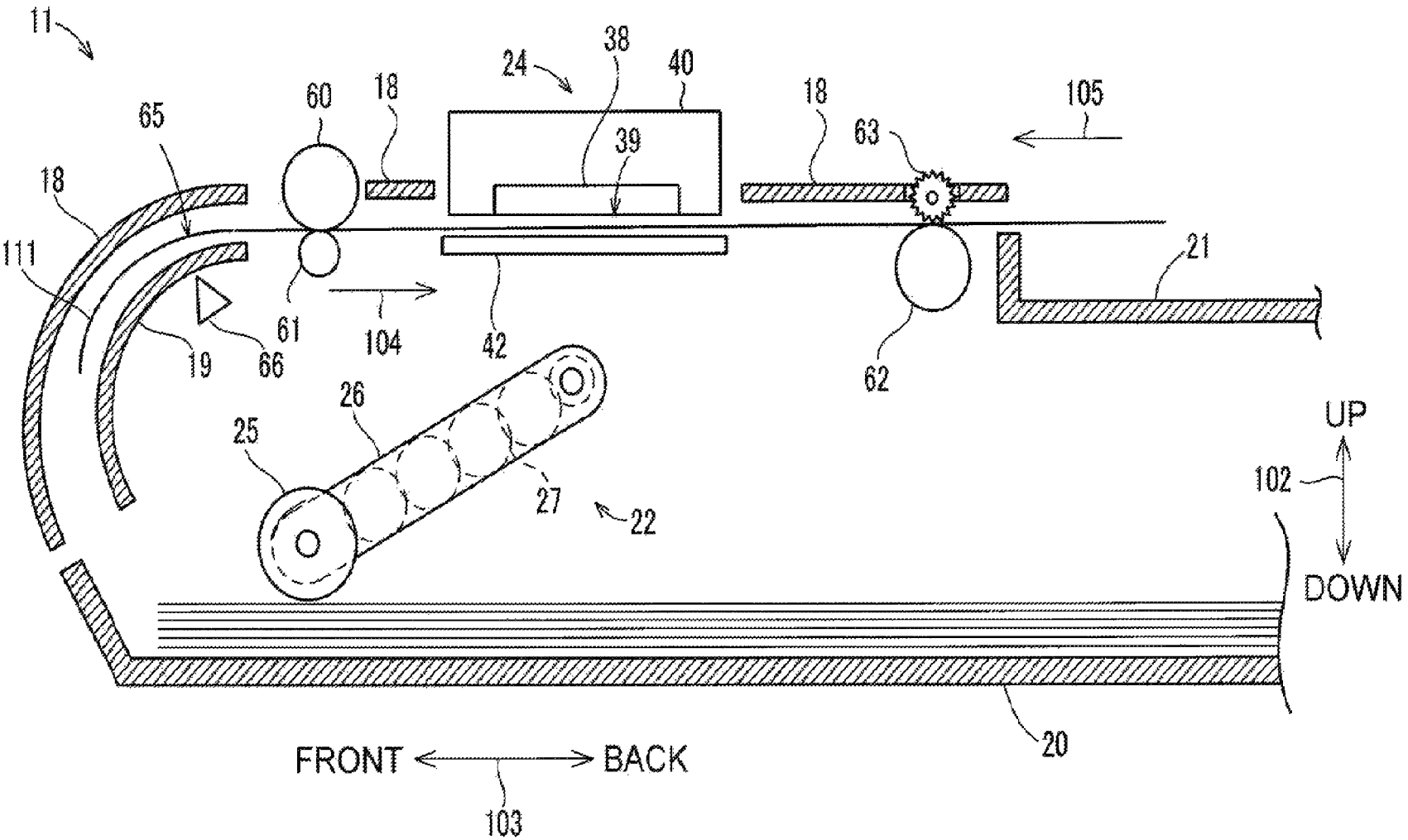
FIG. 7 is another vertical, cross-sectional view depicting the image recording operation of FIG. 6.

As depicted in FIG. 7, if the trailing end of the image-recorded recording sheet 111 has not yet passed through the detection position of the sensor 66, the sensor 66 may output a detection signal for the recording sheet 111, e.g., YES in step S8. In this case, the control unit 70 may drive the conveying motor 53 CW to rotate the conveying roller 60 and the discharging rollers 62 in the conveying direction 104, and, thereby, may convey the recording sheet 111 in the conveying direction 104 in step S9. When the recording sheet 111 is conveyed in the conveying direction 104 and when the trailing end of the recording sheet 111 passes through the detection position of the sensor 66, the sensor 66 may no longer output a detection signal for the recording sheet 111, e.g., NO in step S8. The control unit 70 may determine the position of the trailing end of the recording sheet 111 based on the amount by which the conveying roller 60 rotates after the sensor 66 stops outputting a detection signal for the recording sheet 111.

Figure 8:
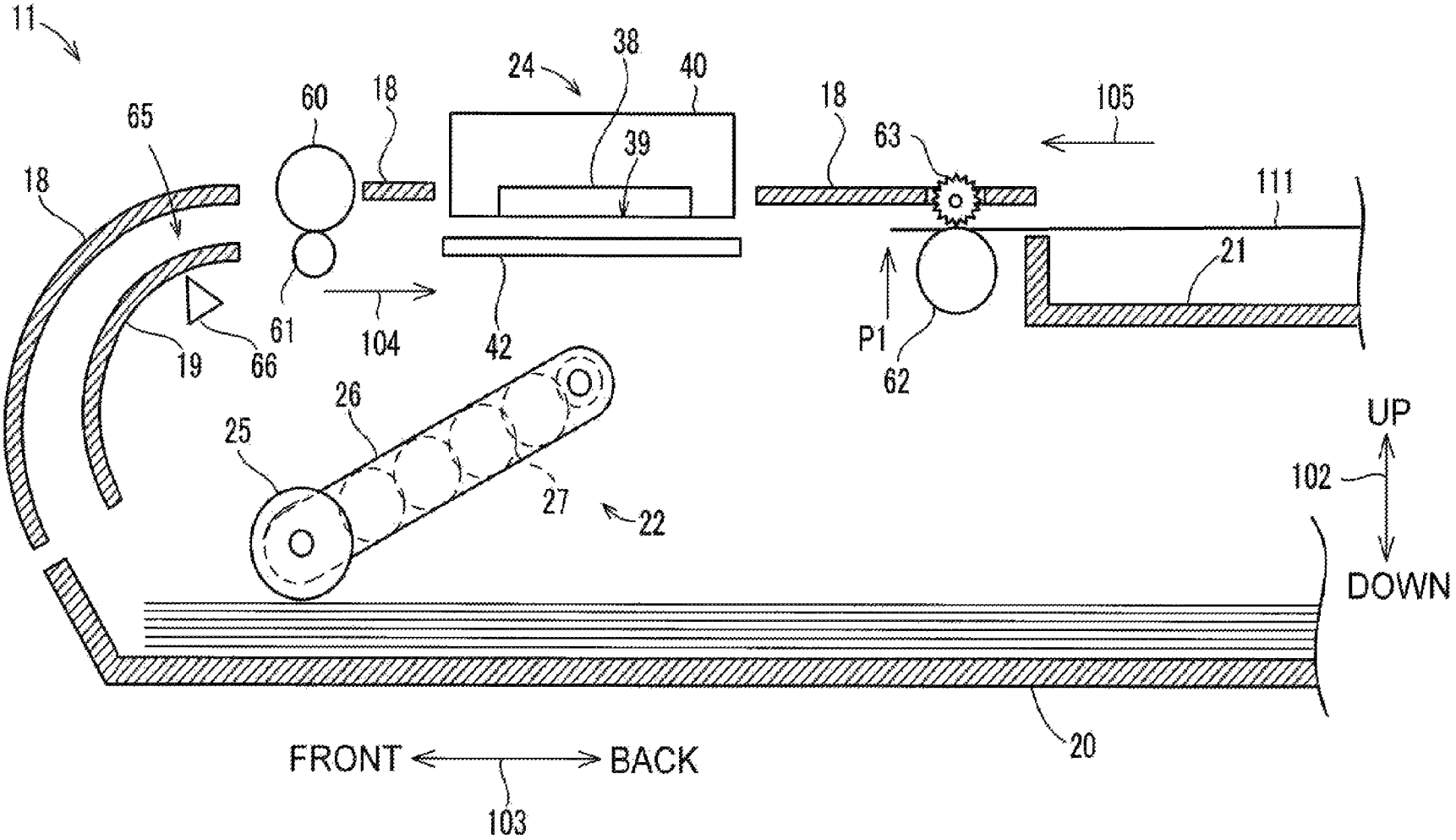
FIG. 8 is still another vertical, cross-sectional view depicting the image recording operation of FIG. 6.

Then, as depicted in FIG. 8, after conveying the recording sheet 111 until the trailing end of the recording sheet 111 reaches a position P1 in step S10, the control unit 70 may stop the conveying motor 53 in step S12. The position P1 may be downstream from the nip between the conveying roller 60 and the pinch rollers 61 and upstream from the nip between the discharging rollers 62 and the spur rollers 63.

After completion of image recording, if the trailing end of the recording sheet 111 has passed through the detection position of the sensor 66, the sensor 66 may not output a detection signal for the recording sheet 111, e.g., NO in step S8. In this case, the control unit 70 may determine the position of the trailing end of the recording sheet 111 based on the amount by which the conveying roller 60 rotates after the sensor 66 stops outputting a detection signal for the recording sheet 111. Therefore, as depicted in FIG. 8, after conveying the recording sheet 111 until the trailing end of the recording sheet 111 reaches the position P1 in step S10, the control unit 70 may stop the conveying motor 53 in step S12. If the trailing end of the recording sheet 111 has already reached the position P1 at the completion of image recording, the control unit 70 may immediately stop the conveying motor 53. In FIG. 8, the position P1 may be downstream from a recording region of the recording unit 24 and upstream from the discharging rollers 62 in the conveying direction 104. Nevertheless, the position P1 may be anywhere between the conveying roller 60 and the discharging rollers 62. Therefore, if the trailing end of the recording sheet 111 has already reached the position P1 at the completion of image recording, step S10 may be skipped.

Figure 12:
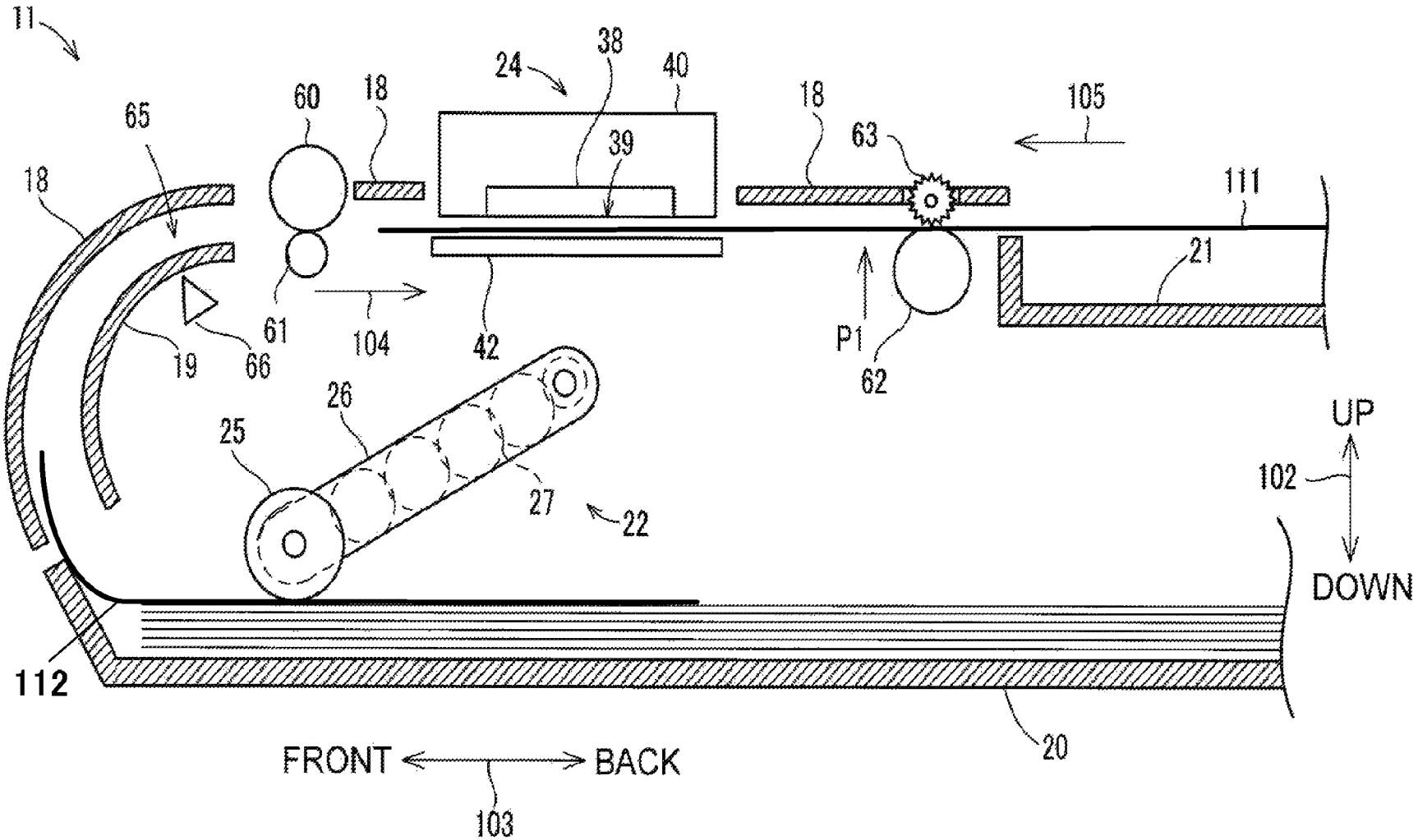
FIG. 12 is still another vertical, cross-sectional view depicting the image recording operation of FIG. 6.

When the trailing end of the image-recorded recording sheet 111 passes through the detection position of the sensor 66, the control unit 70 may drive the feeding motor 51 CW in step S11. The control unit 70 may start to drive the feeding motor 51, as depicted in FIG. 12, before the conveying motor 53 stop, or after the conveying motor 53 stop, or even before completion of image recording. Thus, before the leading end of the next recording sheet 112 may reach the nip between the conveying roller 60 and the pinch rollers 61, image recording on the previous recording sheet 111 may be completed and the trailing end of the recording sheet 111 may reach the position P1. When the feeding motor 51 is driven CW, the feeding roller 25 may rotate to feed the next recording sheet 112 from the feed tray 20 to the conveying path 65.

Figure 9:
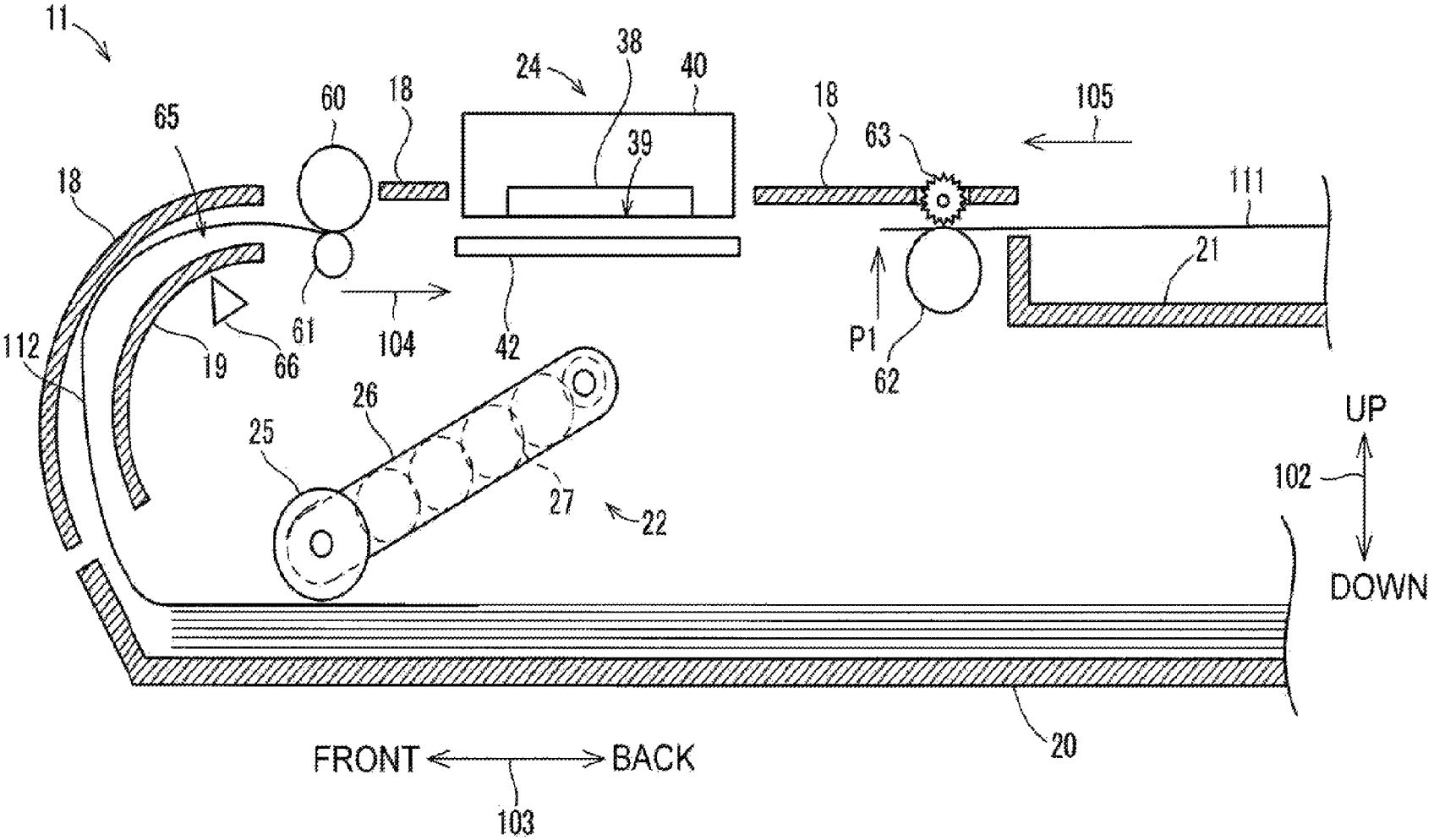
FIG. 9 is yet another vertical, cross-sectional view depicting the image recording operation of FIG. 6.

When the next recording sheet 112 is fed by the feeding roller 25 from the feed tray 20 to the conveying path 65 and the leading end of the recording sheet 112 reaches the sensor 66, the sensor 66 may output a detection signal indicating detection of the recording sheet 112 in step S13. When the detection signal is received, the control unit 70 may determine that the leading end of the recording sheet 112 has reached the sensor 66. The control unit 70 may rotate the feeding motor 51 to further rotate the feeding roller 25 by a predetermined amount after the leading end of the recording sheet 112 reaches the nip between the conveying roller 60 and the pinch rollers 61 in step S14. Thus, as depicted in FIG. 9, the leading end of the recording sheet 112 may contact the conveying roller 60 and the pinch rollers 61 in a stopped state. At the same time, the trailing end of the recording sheet 112 may be conveyed in the conveying direction 104 by the feeding roller 25. Thus, the recording sheet 112 may be warped in the conveying path 65, and the resulting reaction force may cause the leading end of the recording sheet 112 to be registered along the nip between the conveying roller 60 and the pinch rollers 61. That is, stop registration may be performed.

Figure 10:
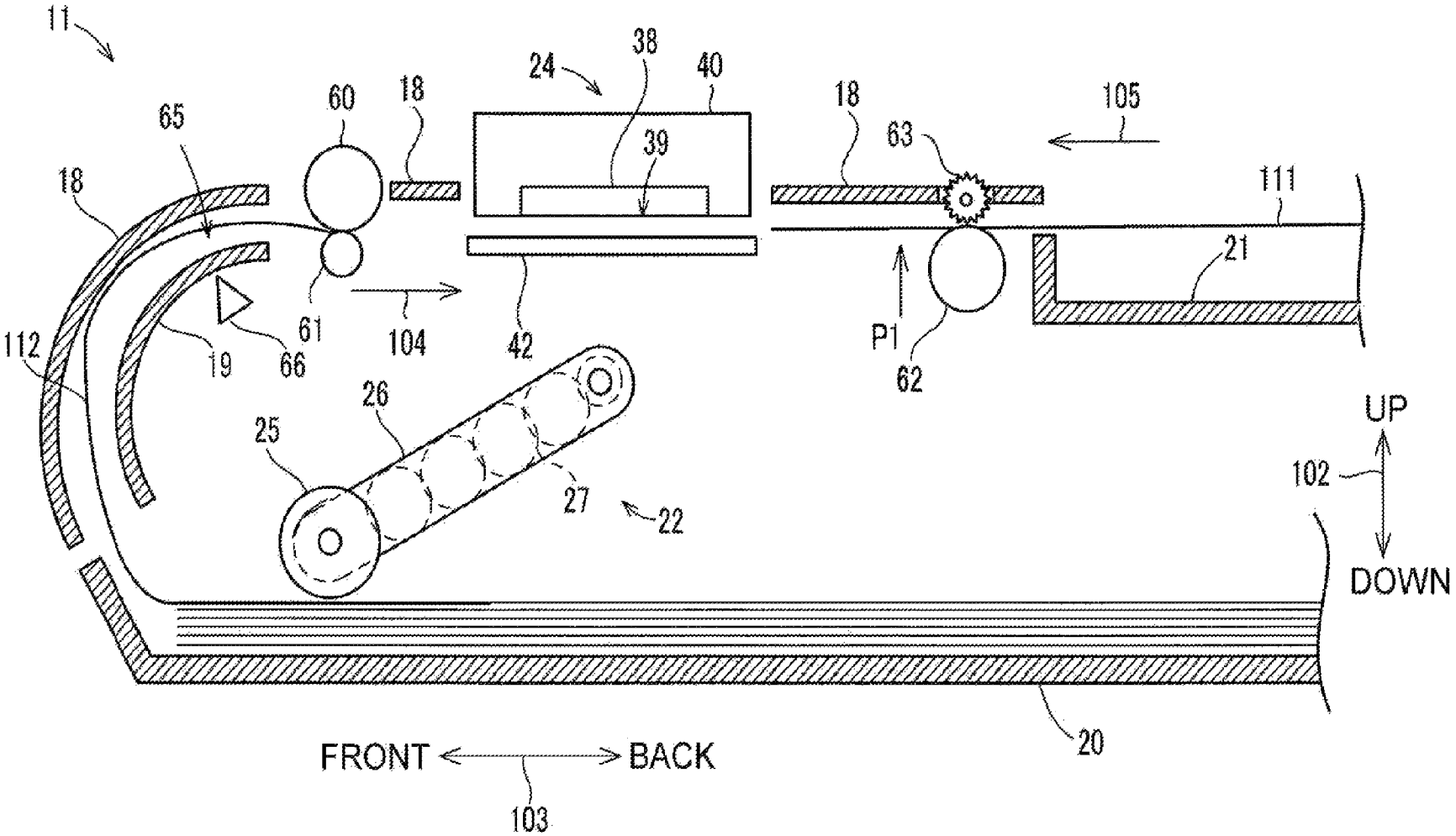
FIG. 10 is still yet another vertical, cross-sectional view depicting the image recording operation of FIG. 6.

After stopping the feeding motor 51, the control unit 70 may drive the conveying motor 53 CCW by a small amount in step S15. The amount of rotation by which the conveying motor 53 may be driven may not allow the trailing end of the image-recorded recording sheet 111 to reach the nip between the conveying roller 60 and the pinch rollers 61. When the conveying motor 53 is driven CCW, as depicted in FIG. 10, the discharging rollers 62 may rotate in the reverse direction 105 to convey the recording sheet 111 backward. Nevertheless, the trailing end of the recording sheet 111 may not be nipped by the conveying roller 60 and the pinch rollers 61. On the other hand, the leading end of the next recording sheet 112 may be registered along the nip between the conveying roller 60 and the pinch rollers 61 rotating in the reverse direction 105.

Then, after temporarily stopping the conveying motor 53, the control unit 70 may perform image recording for one page in step S16. This image recording may substantially be the same as that in step S5 described above. After completion of the image recording for one page, if there is no print data for the next page, e.g., NO in step S17, the control unit 70 may drive the conveying motor 53 CW and may discharge the image-recorded next recording sheet 112 to the output tray 21 in step S18. After completion of the image recording for one page, if there is print data for the next page, e.g., YES in step S17, the control unit 70 may stop the conveying motor 53 after completion of the image recording for one page. After completion of the image recording for one page, the control unit 70 may determine whether the sensor 66 outputs a detection signal for the recording sheet 112 in step S8. Then, the control unit 70 may repeat the series of operations described above.

Effect of Present Embodiment

Before the trailing end of the image-recorded recording sheet 111 passes through the nip between the discharging rollers 62 and the spur rollers 63, the next recording sheet 112 may be fed to the conveying path 65. When the leading end of the next recording sheet 112 contacts the nip between the conveying roller 60 and the pinch rollers 61 in a stopped state, the conveying roller 60 may be rotated in the reverse direction. The speed of recording may increase and the registration process may have a skew correction capability greater than that of registration process performed by the conveying roller 60 in a stopped state.

Second Embodiment

After the leading end of the next recording sheet 112 is registered at the nip between the conveying roller 60 and the pinch rollers 61 in a stopped state, the control unit 70 may drive the conveying motor 53 CCW by an amount of rotation which may not allow the trailing end of the image-recorded recording sheet 111 to reach the nip between the conveying roller 60 and the pinch rollers 61, e.g., step S15 in FIG. 5. In the second embodiment, this amount of rotation may be an amount which may not allow the trailing end of the image-recorded recording sheet 111 to reach a recording region of the recording head 38, e.g., a region directly below the recording head 38. Therefore, the position Pl, at which the trailing end of the image-recorded recording sheet 111 may be stopped, is a position located downstream of the recording region of the recording head 38 and upstream of the nip between the discharging rollers 62 and the spur rollers 63. Thus, even if the conveying motor 53 is driven CCW, the trailing end of the recording sheet 111 may not enter the recording region of the recording head 38 and may be prevented from contacting the recording head 38.

Third Embodiment

After the leading end of the next recording sheet 112 is registered at the nip between the conveying roller 60 and the pinch rollers 61 in a stopped state, the control unit 70 may drive the conveying motor 53 CCW by an amount of rotation which may not allow the trailing end of the image-recorded recording sheet 111 to reach the nip between the conveying roller 60 and the pinch rollers 61, e.g., step S15 in FIG. 5. In the third embodiment, the CCW driving of the conveying motor 53 may be divided into multiple steps, and the CCW driving may be started and stopped repeatedly. When the CCW driving of the conveying motor 53 is stopped, the conveying roller 60 and the pinch rollers 61 may be stopped. This may cause static friction with the leading end of the recording sheet 112 which contacts the conveying roller 60 and the pinch rollers 61. This static friction may be greater than dynamical friction produced between the leading end of the recording sheet 112 and the conveying roller 60 and the pinch rollers 61 in a rotating state. The capability to register the recording sheet 112 may be enhanced.

Fourth Embodiment

After the leading end of the next recording sheet 112 is registered at the nip between the conveying roller 60 and the pinch rollers 61 in a stopped state, the control unit 70 may drive the conveying motor 53 CCW by an amount of rotation which may not allow the trailing end of the image-recorded recording sheet 111 to reach the nip between the conveying roller 60 and the pinch rollers 61, e.g., step S15 in FIG. 5. In the fourth embodiment, this amount of rotation may be an amount corresponding to one or more and less than two teeth of the gear 67 on the conveying roller 60.

As depicted in FIG. 11, the gear 67 may be mounted on a shaft 64 of the conveying roller 60. The gear 67 may engage a gear 68, to which a driving force may be transmitted from the conveying motor 53. The conveying motor 53 may be driven CCW by an amount of rotation corresponding to one or more and less than two teeth of the gear 67. Therefore, when the conveying motor 53 is subsequently driven CW to convey the recording sheet 112 to a stop position, a driving force transmitted from the conveying motor 53 to the conveying roller 60 may be reduced by the amount of backlash in the engagement of the gears 67 and 68. Thus, even if both reverse registration and stop registration are performed on the recording sheets 111 and 112 fed at a high speed, a variation in stop positions may prevented between the recording sheets 111 and 112. Moreover, because the amount of rotation of the conveying roller 60 may be set to an amount corresponding to less than two teeth of the gear 67, the time for driving the conveying motor 53 CCW may be reduced. The loss of time in high-speed feeing mode may be reduced.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A recording device comprising:

a feed roller configured to feed a first sheet and a second sheet sequentially;

a first conveying device configured to convey the first sheet and the second sheet and disposed downstream from the feed roller in a conveying direction, wherein the first conveying device comprises a first driving roller and a first driven roller facing each other;

a recording device configured to perform image recording on the first sheet and the second sheet and disposed downstream from the first conveying device in the conveying direction;

a second conveying device configured to convey the first sheet and the second sheet in synchronization with the first conveying device and disposed downstream from the recording unit in the conveying direction, wherein the second conveying device comprises a second driving roller and a second driven roller facing each other; and a controller configured to control operations of the feed roller, the first conveying device, the second conveying device, and the recording device, wherein the controller is configured to:

stop the first conveying device and the second conveying device when a trailing end of the first sheet reaches a particular position downstream from the first conveying device and upstream from the second conveying device after image recording on the first sheet by the recording unit is complete;

control the feed roller to feed the second sheet, such that a leading end of the second sheet contacts a nip between the first driving roller and the first driven roller of the first conveying device in a stopped state;

stop the feed roller after the leading end of the second sheet contacts the nip between the first driving roller and the first driven roller;

rotate the first driving roller, which is in contact with the leading end of the second sheet, in a reverse direction opposite the conveying direction by an amount of rotation, such that the trailing end of the first sheet does not reach the first conveying device; and control the recording device to perform image recording on the second sheet conveyed in the conveying direction by the first conveying unit.

2. The recording device according to claim 1, after image recording on the first sheet by the recording device is complete, the controller is configured to:

stop the first conveying device and the second conveying device when the trailing end of the first sheet reaches the particular position downstream from a recording region of the recording unit and upstream from the second conveying device; and rotate the first driving roller, which is in contact with the leading end of the second sheet, in the reverse direction by an amount of rotation, such that the trailing end of the first sheet does not reach the recording region.

3. The recording device according to claim 1, further comprising:

a first gear mounted on a shaft of the first driving roller; and a second gear configured to engage the first gear and receive a driving force from a driving source, wherein the controller rotates the first driving roller, which is in contact with the leading end of the second sheet, in the reverse direction by an amount corresponding to greater than one tooth and less than two teeth of the first gear.

4. The recording device according to claim 1, wherein after repeatedly starting and stopping rotation of the first driving roller in the reverse direction, the first driving roller contacts the leading end of the second sheet, the controller controls the recording unit to perform image recording on the second sheet conveyed in the conveying direction by the first conveying device.

5. The recording device according to claim 1, further comprising a sensor disposed upstream from the first conveying device in the conveying direction and configured to detect the first sheet and the second sheet, wherein upon completion of image recording performed on the first sheet by the recording device, if the sensor does not detect the first sheet, the controller drives the feed roller to feed the second sheet.

6. The recording device according to claim 5, wherein upon completion of image recording performed on the first sheet by the recording unit, if the sensor detects the first sheet, the controller drives the first conveying device and the second conveying device to convey the first sheet in the conveying direction, and if the sensor does not detect the first sheet, the controller unit drives the feeding roller to feed the second sheet.

7. The recording device according to claim 1, wherein the controller is configured to control the feed roller to feed the first sheet, such that a leading end of the first sheet contacts the nip in the first conveying device while rotating the first driving roller in the reverse direction, and control the recording unit to perform image recording on the first sheet conveyed in the conveying direction by the first conveying unit.

8. The recording device according to claim 1, further comprising:

a first detection device configured to detect the amount of driving of the feed roller;

a second detection device configured to detect the amount of driving of the first driving roller and the second driving roller;

wherein the controller is configured to judge the position of the leading end of the first sheet and the second sheet between the feed roller and the nip in the first conveying device, based on the amount of driving of the feed roller detected by the first detection unit;

wherein the controller is configured to judge the position of the leading end and the trailing end of the first sheet and the second sheet between the first conveying device and the second conveying device based on the amount of driving of the first driving roller and the second driving roller detected by the second detection unit.

9. The recording device according to claim 1, wherein the controller start drive the feed roller to feed the second sheet before the first conveying device and the second conveying device stop when a trailing end of the first sheet reaches the particular position.

* * * * *